US007918983B2

(12) United States Patent
Saijo et al.

(10) Patent No.: US 7,918,983 B2
(45) Date of Patent: Apr. 5, 2011

(54) SUBSTRATE PLATING METHOD AND APPARATUS

(75) Inventors: Yasuhiko Saijo, Fujisawa (JP); Keisuke Hayabusa, Fujisawa (JP); Masanori Hayase, Tokyo (JP); Yuya Touke, Tokyo (JP)

(73) Assignee: Ebara Corporation, Tokyo (JP)

( * ) Notice: Subject to any disclaimer, the term of this patent is extended or adjusted under 35 U.S.C. 154(b) by 911 days.

(21) Appl. No.: 11/727,357

(22) Filed: Mar. 26, 2007

(65) Prior Publication Data

US 2007/0227894 A1 Oct. 4, 2007

(30) Foreign Application Priority Data

Mar. 28, 2006 (JP) ..... 2006-088956

(51) Int. Cl.
*C25D 5/02* (2006.01)

(52) U.S. Cl. ..... 205/118; 205/220

(58) Field of Classification Search ..... 205/157, 205/170, 298, 118, 220
See application file for complete search history.

(56) References Cited

U.S. PATENT DOCUMENTS

| | | | | |
|---|---|---|---|---|
| 6,432,821 | B1 * | 8/2002 | Dubin et al. | 438/678 |
| 6,638,411 | B1 * | 10/2003 | Mishima et al. | 205/210 |
| 7,449,098 | B1 * | 11/2008 | Mayer et al. | 205/118 |
| 2002/0175080 | A1 * | 11/2002 | Teerlinck et al. | 205/291 |
| 2004/0231998 | A1 * | 11/2004 | Josell et al. | 205/183 |

FOREIGN PATENT DOCUMENTS

| | | |
|---|---|---|
| JP | 2003-328180 | 11/2003 |
| JP | 2006-274369 | 10/2006 |
| JP | 2006-307279 | 11/2006 |

* cited by examiner

*Primary Examiner* — Luan V Van
(74) *Attorney, Agent, or Firm* — Wenderoth, Lind & Ponack, L.L.P.

(57) ABSTRACT

A substrate plating method makes it possible to plate a metal, such as copper or a copper alloy, uniformly into fine recesses in a substrate without forming voids in the metal-filled recesses. The substrate plating method for filling a metal into fine recesses in a surface to be plated of a substrate includes carrying out first plating on the surface to be plated in a plating solution containing a plating accelerator as an additive, carrying out plating accelerator removal processing by bringing a remover, having the property of removing or decreasing the plating accelerator adsorbed on the plating surface, into contact with the plating surface, and then carrying out second plating on the plating surface at a constant electric potential.

11 Claims, 4 Drawing Sheets

SUBSTRATE PLATING METHOD AND APPARATUS

BACKGROUND OF THE INVENTION

1. Field of the Invention

The present invention relates to a technique for forming interconnects of a semiconductor device, and more particularly to a substrate plating method and apparatus suited to fill a metal, such as copper (Cu), into recesses (e.g., trenches) for interconnects, formed on a semiconductor substrate.

2. Description of the Related Art

Conventional integrated circuits (ICs), which employ two-dimensional packaging of circuits onto a semiconductor substrate, have increased the integration degree by making circuits finer. The current circuit design rule is already in the 90 nm generation, and the 45 nm design rule is in a developmental stage when finer circuits are becoming difficult with two-dimensional packaging of circuits. In order to further increase the degree of integration, studies have been made actively on three-dimensional packaging which involves the lamination of a plurality of semiconductor substrates and the formation of interconnects that penetrate the laminate of semiconductor substrates.

A damascene process is currently used widely for the formation of copper interconnects in a semiconductor substrate. The damascene process comprises filling interconnect trenches formed in a semiconductor substrate (Si wafer) with copper, and removing extra deposited copper, e.g., by CMP (chemical mechanical polishing) to form copper interconnects in the trenches. Electroplating is mainly used for the filling of copper because preferential progress of plating from the bottoms of trenches becomes possible by carrying out electroplating using a plating solution which is an acidic copper sulfate solution containing certain types of additives. The additives generally include an inhibitor based on PEG (polyethylene glycol), a plating accelerator based on SPS [bis(3-sulfopropyl)disulfide], a leveler and chloride ion ($Cl^-$).

When carrying out plating by bringing a surface into contact with a plating solution containing PEG and $Cl^-$, the plating surface is basically in a plating-inhibited condition due to adsorption of PEG and $Cl^-$ onto the surface. A plating accelerator, such as SPS, when added to the plating solution, is considered to be adsorbed onto the plating surface upon plating and weakens the plating inhibiting effect of PEG and $Cl^-$, thereby accelerating the progress of plating. As shown in FIG. 4, as plating progresses, the surface area decreases in the bottom corners 23 of a trench 21 formed in a semiconductor substrate (Si wafer) 20, whereby a plating accelerator, having a strong property of remaining on a surface, becomes condensed to increase its coverage. This may explain preferential progress of electrodeposition in the bottom of the trench 21.

A plating solution also containing a leveler is widely used in actual copper plating. Unlike PEG, a leveler by itself adheres to a plating surface and strongly inhibits plating. The leveler that has been adsorbed onto the plating surface is considered to be consumed with the progress of plating either by being taken into the copper plated film or by decomposition. Accordingly, the concentration of the leveler in the plating solution, which has intruded into the depth of a recess such as the trench 21, decreases by a diffusion-controlling mechanism. Thus, the leveler is adsorbed onto a plating surface in a high amount on the outer surface where the plating solution having a high leveler concentration is present, thus strongly inhibiting plating. On the other hand, in a recess, especially in its deeper portion, the leveler concentration of the plating solution decreases and adsorption of the leveler onto a plating surface decreases, resulting in weaker inhibition of plating. Progress of plating from the depth of the trench 21 can thus be expected. It is the current general view that the use of a plating solution containing such additives is essential to filling of a metal by electroplating into large trenches for three-dimensional packaging.

As described above, in the bottom-up metal-filling mechanism, a plating accelerator in a plating solution becomes condensed in the bottom corners 23, thus accelerating plating in the bottom. Though an amount of a plating accelerator adsorbed on a plating surface (or surface to be plated) is small on or shortly after immersion of the surface in the plating solution, because of the accelerator's strong property of remaining on the plating surface, the amount of the plating accelerator adsorbed on the plating surface gradually increases with the progress of plating. Thus, the adsorption reaches saturation in due course when the plating accelerator is adsorbed in a considerable amount on the entire plating surface irrespective of the surface configuration. For example, when carrying out plating at a current density of about 100 $A/m^2$, the increase in the amount of a plating accelerator adsorbed on a plating surface will almost come to saturation after about a 10-minute period of plating.

Trenches for forming interconnects in a semiconductor substrate have a width dimension of several μm to several tens nm and a depth dimension of about 1 μm, whereas trenches for use in three-dimensional packaging, on the other hand, have a width dimension of 10 to 20 μm and a depth dimension of 50 to 100 μm, and thus is two orders of multitude larger than the former trenches. It is difficult to carry out plating of a substrate surface having such large trenches in a bottom-up manner because of the following two main reasons:

(1) In the case of trenches for interconnects in a semiconductor substrate, filling of a metal into the trenches by electroplating is generally completed within several minutes. Therefore adsorption of a plating accelerator onto a plating surface does not reach saturation, thus not causing any problem associated with saturation of the adsorption. In the case of large trenches for three-dimensional packaging, on the other hand, it can take several hours to fill a metal into the trenches by electroplating. Accordingly, adsorption of a plating accelerator in a plating solution onto a plating surface reaches saturation, when the plating accelerator is adsorbed on the entire plating surface. Thus, the plating accelerator has been condensed in the bottom corners 23 shown in FIG. 4, thereby accelerating plating in the bottom portions of the trench. At the same time, a considerable amount of the plating accelerator is adsorbed also on the other portion of the plating surface than the bottom corners 23. There is therefore no significant difference in the plating rate between the bottom corners 23 and the other portion.

(2) In the case of large trenches for three-dimensional packaging, the trench 21 shown in FIG. 4 is deep. Therefore, the concentration of copper ions in a plating solution decreases in the deep portion of the trench 21 because of diffusion-controlling mechanism. Accordingly, even if there is a sufficient effect of the plating accelerator, the plating rate is low in the bottom of the trench 21 due to an insufficient supply of copper ions.

Though filling of copper into trenches has been achieved by electroplating using a plating solution comprising an acidic copper sulfate solution containing the above-described additives, the plating takes a considerable amount of time and, in addition, control of such a plating bath necessitates a complicated operation (see Japanese Patent Laid-Open Publication No. 2003-328180).

SUMMARY OF THE INVENTION

The present invention has been made in view of the above situation in the related art. It is therefore an object of the present invention to provide a substrate plating method and apparatus which makes it possible to plate a metal, such as copper or a copper alloy, uniformly into fine recesses formed in a substrate, such as fine interconnect trenches (including trenches for forming interconnects in a substrate and trenches for three-dimensioned packaging), without forming voids in the metal-filled recesses.

In order to achieve the object, the present invention provides a substrate plating method for filling a metal into fine recesses in a surface to be plated of a substrate, comprising: carrying out first plating on the surface to be plated in a plating solution containing a plating accelerator as an additive; carrying out plating accelerator removal processing by bringing a remover, having the property of removing or decreasing the plating accelerator adsorbed on the plating surface, into contact with the plating surface; and then carrying out second plating on the plating surface at a constant electric potential.

The plating accelerator preferably comprises a sulfur compound.

Preferably, the remover removes by competitive adsorption the plating accelerator adsorbed on the plating surface.

The remover may comprise chloride ions.

In a preferred aspect of the present invention, the plating accelerator removal processing is carried out by reverse electrolytic processing with the polarity of the substrate reversed from that of the first plating.

Preferably, the second plating is carried out by using a plating solution not containing a plating accelerator.

The present plating method may be carried in such a manner that a change in electric current is detected during the constant-potential second plating. When the detected current value has decreased to a predetermined value or lower with respect to the initial current value, the first plating and the plating accelerator removal processing are carried out again, and then the constant-potential second plating is carried out again.

The present invention also provides a substrate processing apparatus for filling a metal into fine recesses in a surface to be plated of a substrate, comprising: a first plating cell for carrying out first plating on the surface to be plated in a plating solution containing a plating accelerator as an additive; a plating accelerator removal section for bringing a remover, having the property of removing or decreasing the plating accelerator adsorbed on the plating surface, into contact with the plating surface; and a second plating cell for carrying out second plating on the plating surface at a constant electric potential.

In a preferred aspect of the present invention, the plating accelerator removal section includes an electrolytic cell having an electrode and an electrolytic solution and is adapted to carry out reverse electrolytic processing with the polarity of the substrate reversed from that of the first plating and the second plating.

Even when increasing the intensity of stirring of a plating solution during plating to physically promote supply of copper ions to deep portions of trenches so that the rate of progress of plating in the deep portions of the trenches will not be significantly lowered due to a shortage of copper ions, the effect has its own limit.

It was the conception of the present inventors that if plating can be carried out with a low rate of progress of plating at the outer surface of a plating surface and in the vicinities of the openings of trenches while suppressing adsorption of a plating accelerator onto the plating surface in those portions, a decrease in the concentration of copper ions in the deep portions of the trenches will be overcome by condensation of the plating accelerator and such a rate of progress of plating that causes bottom-up with respect to the outer surface and the vicinities of the openings of the trenches will be obtained. Referring to FIG. 4, the outer surface 26 herein refers to that surface portion of the plating surface (or the surface to be plated) of the substrate 20 which lies outside the trench 21, and the vicinity 25 of the opening of the trench refers to an area of the plating surface inside the trench 21 such that the rate of diffusion of an ion in a plating solution or an electrolytic solution during plating or electrolytic processing does not control or limit the rate of progress of plating or the rate of removal of a plating accelerator. Thus, the vicinity 25 of the opening of the trench refers to a relatively shallow region in the trench 21, as distinct from the deep portion 27 which refers to a deep region in the trench 21 where the rate of diffusion of an ion during plating or electrolytic processing will control or limit the rate of progress of plating or the rate of removal of the plating accelerator.

It has been found by the present inventors that chloride ions are effective for suppressing condensation of a plating accelerator, and that the effect is marked especially when carrying out reverse electrolytic processing in the presence of chloride ion by applying the reverse electric field from that of plating. More specifically, by bringing an electrolytic solution, comprising the usual components for copper electroplating, except for not containing a plating accelerator and having an increased chloride ion concentration, into contact with a plating surface of a substrate, and more effectively by applying the reverse electric field from that of plating to the electrolytic solution, a plating accelerator adsorbed on the plating surface is competitively replaced with chloride ions (competitive adsorption), whereby the amount of the plating accelerator adsorbed on the plating surface decreases.

If reverse electrolytic processing is carried out with the same plating solution used for bottom-up filling of copper, i.e., without changing the plating (electrolytic) solution, the interconnects will be dissolved to some degree, and therefore the plating configuration will change. Such processing, however, is in fact not effective for removal of a plating accelerator.

It is noted in this regard that merely dissolving the surface of, e.g., a copper plated film is insufficient for removal of a plating accelerator from the surface of the copper plated film, and it is necessary to inhibit re-adsorption of the plating accelerator onto the surface of the copper plated film, for example, by replacing the plating accelerator adsorbed on the surface of the copper plated film with another ion, in addition to dissolution of the surface of the copper plated film.

This method makes it possible to promote desorption of a plating accelerator from the outer surface and the vicinities of the openings of trenches and to adjust a trench depth level at which promotion of desorption of the plating accelerator is possible. The concentration of chloride ions ($Cl^-$) may preferably be not more than 200 mM (millimole/Liter). When reverse electrolytic processing is carried out at such a chloride ions concentration and at a current density of about 100 $A/m^2$, a concentration gradient of chloride ions ($Cl^-$) is generated immediately after the start of processing and chloride ions ($Cl^-$) run out in the deep portions of trenches.

When plating is resumed by using a plating bath containing an inhibitor (PEG and $Cl^-$) but not containing a plating accelerator, the progress of plating is strongly inhibited by the inhibitor on the outer surface and in the vicinities of the openings of trenches, and the deep portions of the trenches are plated preferentially due to the presence of the plating accelerator remaining in the plating solution.

Filling of a plated metal into trenches or holes without the formation of voids in the metal-filled trenches or holes is thus possible when the trenches or holes are relatively small. On the other hand, in the case of trenches for three-dimensional packaging, a considerably long plating time is required because of the large size of the trenches, which involves the problem of difficulty in continuing preferential deposition of a metal in the deep portions of the trenches until the end of plating.

It has also been found by the present inventors that the difficulty in continuing preferential metal deposition in the deep portions of such large trenches is due to a change in plating overvoltage in the case of constant-current plating and by an associated change in the balance of adsorption of additives. The mechanism is considered as follows:

Condensation of a plating accelerator during plating, while producing the effect of accelerating plating, causes lowering of plating overvoltage under constant-current conditions. Although the plating accelerator tends to remain on a surface, it is taken into a plated film when the plating overvoltage is too low. When the plating accelerator in the plating solution is thus lost, preferential metal deposition comes to a stop. On the contrary, if plating is carried out at an increased current in consideration of the lowering of overvoltage due to the condensation of the plating accelerator, then adsorption of an inhibitor increases, causing a gradual decrease in adsorption of the plating accelerator.

In summary, ideal filling of a metal into trenches could be achieved by plating if the balance between condensation of a plating accelerator and adsorption of an inhibitor can be kept during plating. In constant-current plating, however, this balance can be kept only for a short limited time. Thus, in the case of a substrate having large-sized trenches, it is very difficult to keep the balance until the end of plating, i.e., until filling of the trenches is completed.

It has now been found that in order to keep the balance between condensation of a plating accelerator and adsorption of an inhibitor for a long time and carry out efficient filling of the metal into trenches with fewer repetition of the process, plating after the step of removing a plating accelerator (more precisely, replacing a plating accelerator with chloride ion ($Cl^-$)) is best carried out at a constant electric potential.

The process of the present invention will be summarized as follows. Three types of solutions, having distinct compositions of components, are used in the process.

(1) First plating of a surface of a substrate is carried out by using a plating solution capable of bottom-up filling of a metal into trenches, i.e., a plating solution containing a plating accelerator as an additive, thereby allowing a certain amount of the plating accelerator to be adsorbed onto the surface.

(2) Plating accelerator removal processing is then carried out by using an electrolytic solution, having a relatively high concentration of chloride ions ($Cl^-$) and not containing a plating accelerator, and applying the reverse electric field from that of the first plating, thereby replacing the plating accelerator, present on the outer surface of the substrate and in the vicinities of the openings of the trenches, with chloride ions ($Cl^-$) while leaving the plating accelerator in the deep portions of the trenches.

(3) Second plating is then carried out at a constant electric potential by using a plating solution not containing a plating accelerator while keeping the balance of adsorption of additives.

DETAILED DESCRIPTION OF THE PREFERRED EMBODIMENTS

Figure 1:
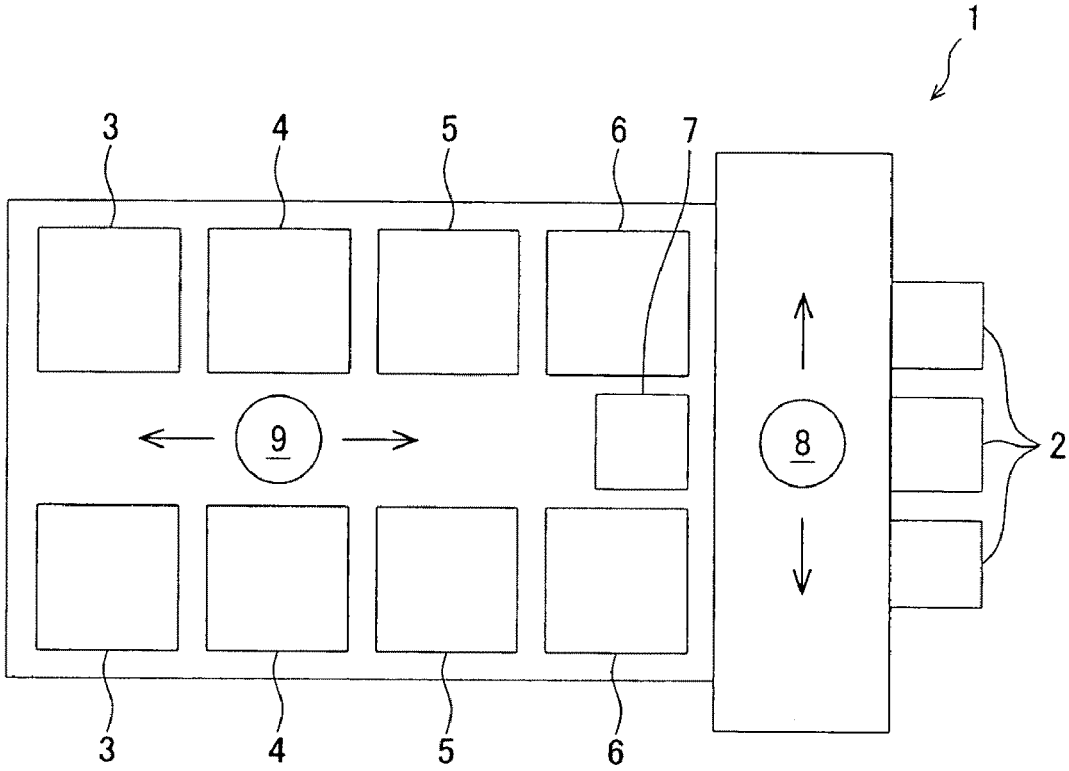
FIG. 1 is an overall plan view of a substrate plating apparatus to which the present invention is applied.

Preferred embodiments of the present invention will now be described in detail with reference to the drawings.

The following three process steps are carried out according to the present invention:

(1) Plating for adsorption of a plating accelerator (first plating)

(2) Reverse electrolytic processing for leaving the plating accelerator in the deep portions of trenches (plating accelerator removal processing)

(3) Plating carried out at a constant electric potential while keeping the balance of adsorption of additives (second plating)

There is no need to carry out a cleaning step between the above steps. An amount of a plating solution (or an electrolytic solution), which is brought with a substrate from a process step to the next process step, usually will not cause any problem in the next processing. The respective process steps will now be described in more detail.

(1) Plating for Adsorption of a Plating Accelerator (First Plating)

The first plating of a substrate having fine recesses is carried out in a plating solution containing a plating accelerator as an additive, thereby filling a metal into the fine recesses. In order to prevent bubbles from remaining in deep holes or trenches of the substrate, it is preferred to perform bubble removal in advance by immersing the substrate in degassed water.

The plating solution for adsorption of the plating accelerator onto the substrate may contain copper sulfate, sulfuric acid, an inhibitor, a plating accelerator, and chloride ions ($Cl^-$). A leveler is not added to the plating solution. A polymer, exemplified typically by PEG (polyethylene glycol) can be used as the inhibitor. SPS [bis(3-sulfopropyl)disulfide] is a typical example of the plating accelerator.

Examples of the plating accelerator include brighteners described in Japanese Patent Laid-Open Publication No. 2000-219994, i.e., bis(3-sulfopropyl)disulfide and its disodium salt, bis (2-sulfopropyl)disulfide and its disodium salt, bis (3-sul-2-hydroxypropyl)disulfide and its disodium salt, bis (4-sulfopropyl)disulfide and its disodium salt, bis (p-sulfophenyl)disulfide and its disodium salt, 3-(benzothiazolyl-2-thio)propylsulfonic acid and its sodium salt, N,N-dimethyldithiocarbamic acid-(3-sulfopropyl)-ester and its sodium salt, O-ethyl-diethylcarbonic acid-S-(3-sulfopropyl)-ester and its potassium salt, thiourea and its derivatives, etc.; and sulfur-containing saturated organic compounds described in Japanese Patent Laid-Open Publication No. 2000-248397, i.e., dithiobis-alkane-sulfonic acid and its salts, specifically, 4,4-dithiobis-butane-sulfonic acid, 3,3-dithiobis-propane-sulfonic acid, 2,2-dithiobis-ethane-sulfonic acid, and their salts, etc. These compounds may be used singly or as a mixture of two or more. The above compounds are all sulfur-containing compounds (sulfur compounds).

The plating is carried out at a constant current and terminated by the time that the amount of the plating accelerator adsorbed on the substrate reaches a saturation amount, at the latest. Such plating time will generally be 10 minutes at the longest. The adsorption of the plating accelerator reaches saturation in a short time if plating is carried out under improper conditions. When it is intended to allow a larger amount of plating accelerator to be adsorbed onto the plating surface in the deep portions of trenches, the plating time is desirably made longer so as to cause more condensation of the plating accelerator in the deep portions with the progress of plating.

The current density during plating is preferably in the range of 10-100 $A/m^2$. When the current density is too high, there is a fear that, due to increased adsorption of the inhibitor, adsorption of the plating accelerator may not progress as desired. When the current density is too low, on the other hand, there is a fear that the plating accelerator may be taken into a plated film, so that adsorption of the plating accelerator may not progress as desired. In some case, the first plating may be carried out at a constant electric potential.

(2) Reverse Electrolytic Processing for Leaving the Plating Accelerator in the Deep Portions of Trenches (Plating Accelerator Removal Processing)

The plating accelerator removal processing is carried out by bringing a remover, having the property of removing or decreasing the plating accelerator adsorbed on the plating surface, into contact with the plating surface. An electrolytic solution containing the remover is used. Preferably, the electrolytic solution basically has the same components as the plating solution used in the metal-filling plating (first plating), but does not contain a plating accelerator. Anew component may be added to more effectively remove the plating accelerator.

Though the concentrations of the components of the electrolytic solution may vary from case to case, the concentration of chloride ions in the solution should preferably be made higher than that of the plating solution used in the first plating and is, for example, 1 mg/L to 100 mg/L.

Copper is preferably used as a material for a cathode electrode for use in reverse phase processing carried out using the electrolytic solution.

The reverse electrolytic processing is carried out under constant-current conditions. From the viewpoint of effective removal of the plating accelerator, it is preferred to control the stirring conditions of the solution according to the interconnect pattern of the substrate, etc.

The reverse electrolytic processing can be sufficiently completed in such a length of time that will allow effective removal of the plating accelerator from a plated film of, e.g., copper. It is not necessary for the reverse electrolytic processing to dissolve the plated film itself.

Halide ions (chloride ions, bromide ions, iodide ions, astatide ions, etc.) can be used as the remover. Of these, chloride ion is most preferred. A halide such as, hydroacid, sodium salt or potassium salt of chlorine, bromine or iodine may be used as a supply source of halide ions. Specific examples of such halides include hydrochloric acid, sodium chloride, potassium chloride, hydrobromic acid, sodium bromide, potassium bromide, hydroiodic acid, sodium iodide, potassium iodide, etc. Hydrochloric acid, sodium chloride, potassium chloride, etc. may be used as a supply source for chloride ions.

(3) Plating Carried Out at a Constant Electric Potential while Keeping the Balance of Adsorption of Additives (Second Plating)

The second plating is carried out at a constant electric potential. A plating solution for use in the second plating may have the same composition as the plating solution used in the first plating, except for not containing a plating accelerator. The constant electric potential during plating is preferably in the range of −0.6V to −0.5V on the basis of a mercury/mercury sulfate electrode (saturated potassium sulfate). This is because when the electric potential is lower than −0.6V, adsorption of the inhibitor is likely to exceed adsorption of the plating accelerator, whereas when the electric potential is higher than −0.5V, the plating accelerator is likely to be taken into a plated film, making it difficult to keep the balance of adsorption of the additives for a long time.

When an increase in the plating rate is intended, it is necessary to lower the electric potential, with −0.6V being the lower limit. In this case, it is desirable to detect a change in electric current during plating and, when the current value has decreased to a predetermined value, for example, a value of not more than 80%, preferably not more than 90% of the initial current value, repeat the first plating and the plating accelerator removal processing, and then carry out the second plating again.

FIG. 1 is an overall plan view of a substrate plating apparatus to which the present invention is applied. As shown in FIG. 1, the plating apparatus 1 includes three loading/unloading sections 2 for housing a plurality of substrates W therein, first plating cells 3, 3 for carrying out the first plating in a plating solution containing a plating accelerator as an additive, plating accelerator removal sections 4, 4 for carrying out the plating accelerator removal processing by bringing a remover, having the property of removing or decreasing the plating accelerator adsorbed on a plating surface, into contact with the plating surface, second plating cells 5, 5 for carrying out the second plating after the plating accelerator removal processing, cleaning sections 6, 6 for carrying out cleaning of the substrate W, a substrate stage 7 for temporarily placing thereon the substrate W, before or after processing, and transport mechanisms 8, 9 for taking the substrate W out of the loading/unloading sections 2 and transporting the substrate W to the plating cells, etc., and transporting the substrate W after plating from the cleaning sections 6, 6 etc. to the loading/unloading sections 2.

Figure 2:
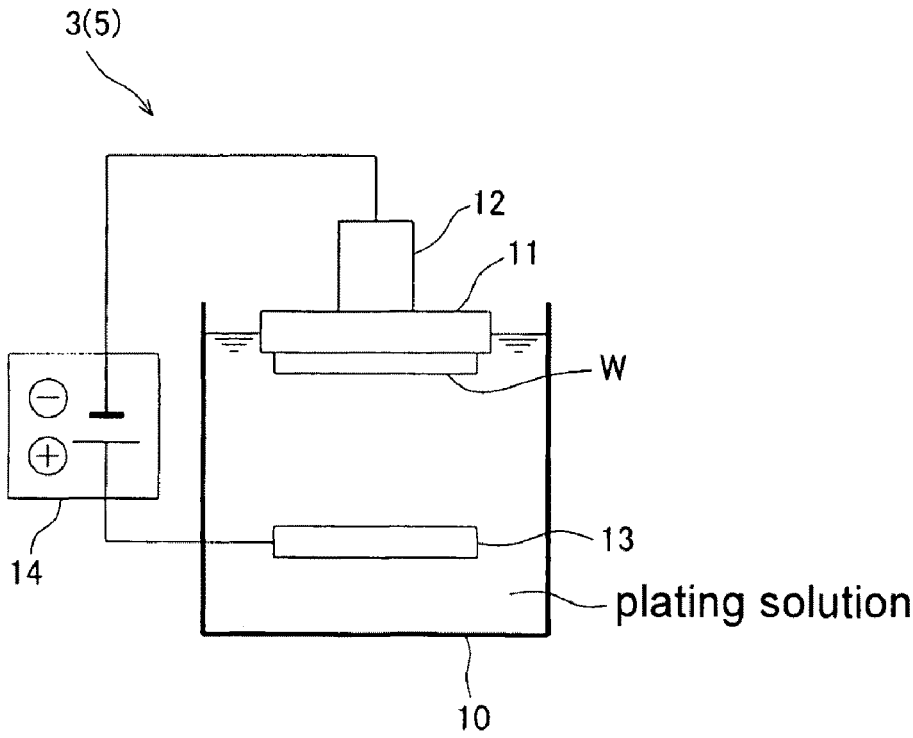
FIG. 2 is a schematic view of a first plating cell or a second plating cell.

The construction of the first plating cell 3 or the second plating cell 5 will now be described. FIG. 2 is a schematic diagram showing the first plating cell 3 or the second plating cell 5. As shown in FIG. 2, the first plating cell 3 or the second plating cell 5 includes a plating cell 10 for storing a plating solution. An electrode (anode) 13 of copper (Cu) and a substrate holder 11 holding a substrate W, positioned above and opposite the electrode 13, are disposed in the plating cell 10. The substrate holder 11 is held by an arm 12, and is movable between the plating cell 10 and a substrate delivery/receipt position (not shown). The electrode 13 and the substrate holder 11 are connected to a power source 14, so that a predetermined voltage is applied between the electrode 13 and the substrate W. With this structure, electroplating of the substrate W is carried out by applying a predetermined voltage from the power source 14 to between the substrate W and the electrode 13 and passing an electric current at a predetermined current density between the substrate W and the electrode 13. The first plating is thus carried in the first plating cell 3, using the above-described plating solution containing a plating accelerator as an additive. The second plating is carried out in the second plating cell 5 after the plating accelerator removal processing.

Figure 3:
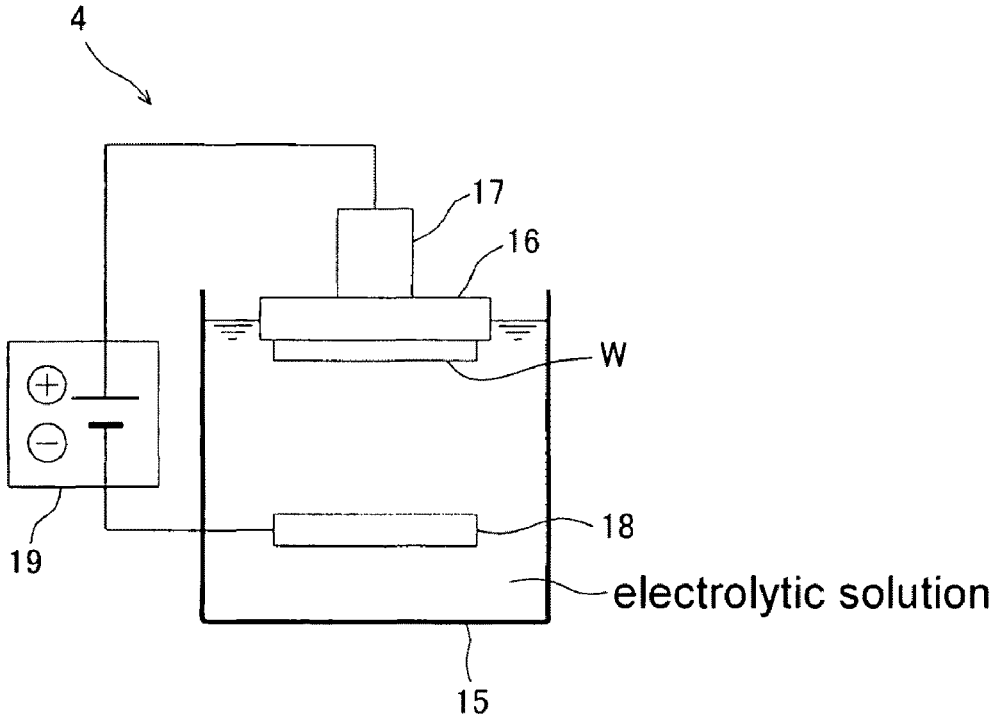
FIG. 3 is a schematic view of a plating accelerator removal section.
Figure 4:
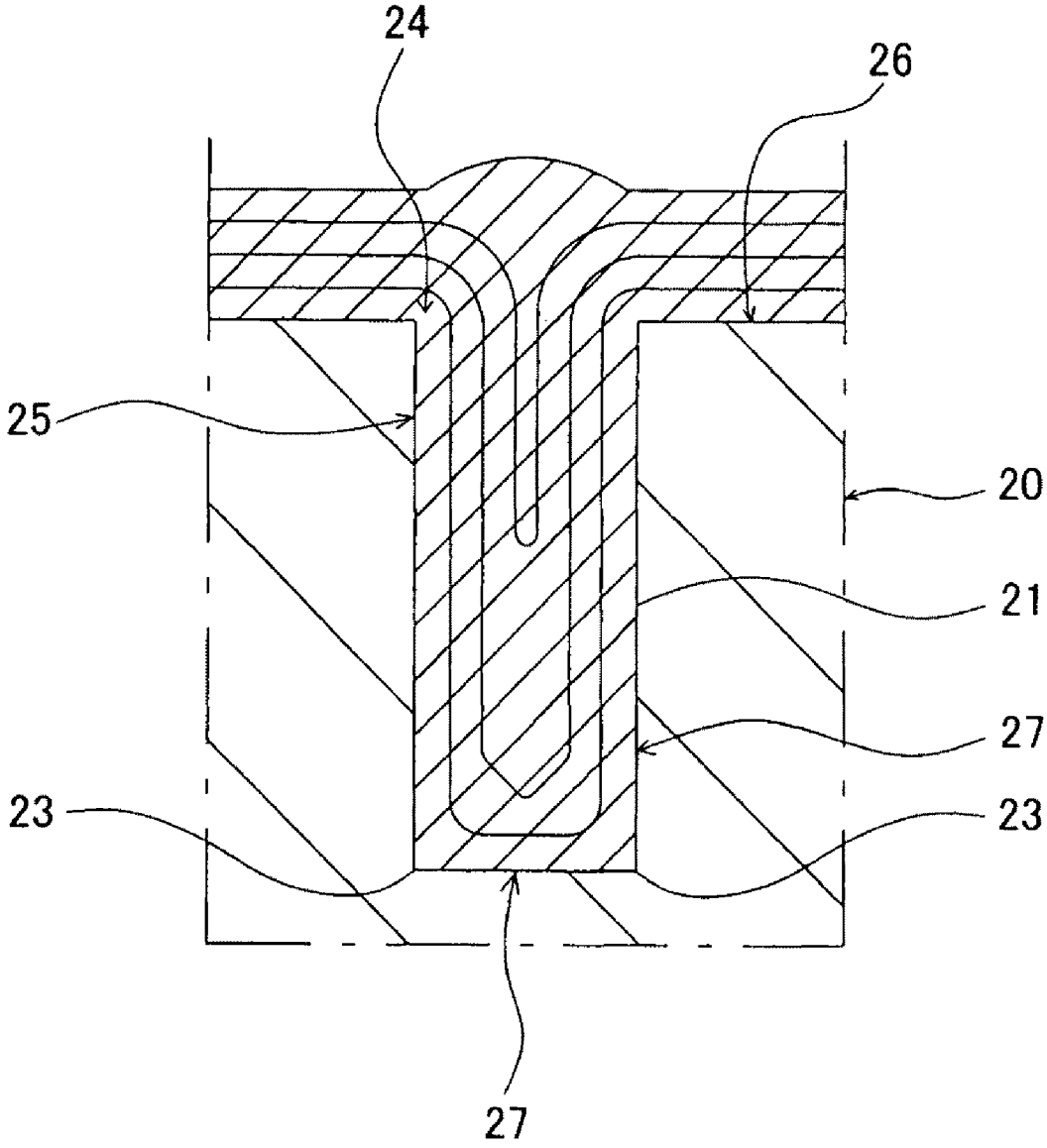
FIG. 4 is a diagram illustrating the progress of plating into a trench formed in a semiconductor substrate.

A description will now be made of the construction of the plating accelerator removal section 4. FIG. 3 is a schematic diagram showing the plating accelerator removal section 4. As shown in FIG. 4, the plating accelerator removal section 4 includes an electrolytic cell 15 for storing an electrolytic solution. An electrode (cathode) 18 of copper (Cu) and a substrate holder 16 holding a substrate W, positioned above and opposite the electrode 18, are disposed in the electrolytic cell 15. The substrate holder 16 is held by an arm 17, and is movable between the electrolytic cell 15 and a substrate delivery/receipt position (not shown). With this structure, reverse electrolytic processing of the substrate W is carried out by applying a voltage, which is of the reverse polarity from that of the plating, from a power source 19 to between the substrate W and the electrode 18.

The operation of the plating apparatus 1 will now be described. Referring to FIG. 1, the transport mechanism 8 takes a substrate W before plating out of a substrate cassette mounted in one of the loading/unloading sections 2, and places the substrate W on the substrate stage 7. The other transport mechanism 9 takes up the substrate W from the substrate stage 7 and transports the substrate W to the substrate delivery/receipt position near the first plating cell 3. In the substrate delivery/receipt position, the substrate holder 11 receives the substrate W from the transport mechanism 9 and holds it, e.g., by vacuum attraction, and the substrate holder 11 then moves to a position in the first plating cell 3 at which the substrate W faces the electrode 13 (see FIG. 2). Thereafter, the first plating of the substrate W is carried out by applying a predetermined voltage from the power source 14 to between the substrate W and the electrode 13 and passing an electric current at a predetermined current density between the substrate W and the electrode 13. The first plating is carried out in the plating solution containing a plating accelerator as an additive.

Though in this embodiment the plating is carried out in a face-down manner in which the substrate W is held with its surface to be plated (processing surface) facing downwardly upon contact with the plating solution, it is also possible to employ a face-up manner in which the substrate W is held with its surface to be plated facing upwardly, the plating solution is held on the surface of the substrate W by utilizing a sealing member surrounding the surface, and an electrode is brought into contact with the plating solution.

After carrying out the first plating for a predetermined time, the substrate W is released from the substrate holder 11, and transported by the transport mechanism 9 to the plating accelerator removal section 4. In the plating accelerator removal section 4, the substrate holder 16 holds the substrate W and moves it to a position in the electrolytic cell 15 at which the substrate W faces the electrode 18 (see FIG. 3). Thereafter, reverse electrolytic processing of the substrate W is carried out by applying a voltage, which is of the reverse polarity from that of the first plating, from the power source 19 to between the substrate W and the electrode 18. For more effective removal of the plating accelerator, the stirring conditions of the electrolytic solution are preferably controlled.

Though in this embodiment the substrate W is processed with its plating surface facing downwardly (face-down), it is of course possible to process the substrate W face-up.

The above-described electrolytic solution, i.e., the electrolytic solution basically having the same components as the plating solution used in the metal-filling plating (first plating), except for not containing a plating accelerator, and optionally containing a new component for more effective removal of the plating accelerator, is preferably used in the plating accelerator removal section 4.

After carrying out the plating accelerator removal processing in the above-described manner in the plating accelerator removal section 4, the substrate W is transported by the transport mechanism 9 to the second plating cell 5. In the second plating cell 5, the substrate W held by the substrate holder 11 is disposed opposite the electrode 13 (see FIG. 2). Thereafter, the second plating of the substrate W is carried out by applying a predetermined constant voltage from the power source 14 to between the substrate W and the electrode 13.

Though in this embodiment the substrate W is plated with its plating surface facing downwardly (face-down), it is of course possible to plate the substrate W face-up.

The above-described plating solution, i.e., the same plating solution as used in the first plating, except for not containing a plating accelerator, is preferably used in the second plating. As described above, the metal-filling plating (first plating), the plating accelerator removal processing and the metal-filling plating at a constant electric potential (second plating) may be carried out again or repeated a plurality of times.

As described previously, there is no need for a cleaning step between the above process steps because bringing-in of some amount of processing solution by a substrate W from one process step to the next process step usually is not problematic. In case the bringing-in of processing solution is problematic, however, the processing solution needs to be cleaned off. In this case, cleaning of the substrate W is carried out in the cleaning section 6 between the process steps by supplying a cleaning liquid to the substrate W to clean off the processing solution. Instead of cleaning the substrate W in the cleaning section 6, it is also possible to carry out cleaning of the substrate W by supplying a cleaning liquid to the plating surface of the substrate W from, e.g., a nozzle provided adjacent to the first plating cell 3, the plating accelerator removal section 4, the second plating cell 5, etc.

After completion of the above process steps, the substrate W is placed on the substrate stage 7 by the transport mechanism 9, and the substrate W is then transported by the transport mechanism 8 and placed into a substrate cassette mounted in one of the loading/unloading sections 2. The series of plating steps for the one substrate W is hereby completed.

EXAMPLES 1 AND 2

Filling of a copper plated film into interconnect trenches provided in a substrate was carried out in the manner described below, using the following baths A to C:

Bath A: Acidic copper sulfate solution
($CuSO_4$, 0.9 M; $H_2SO_4$, 0.56 M)
PEG 0.1 mM
SPS 5.6 μM
Chloride ion ($Cl^-$) 1 mM
Bath B: Acidic copper sulfate solution
($CuSO_4$, 0.9 M; $H_2SO_4$, 0.56 M)
PEG 0.1 mM
SPS None
Chloride ion ($Cl^-$) 50 mM
Bath C: Acidic copper sulfate solution
($CuSO_4$, 0.9 M; $H_2SO_4$, 0.56 M)
PEG 0.1 mM SPS None Chloride ion ($Cl^-$) 1 mM 1. Using the bath A, first plating was carried out at a current density of 100 A/$m^2$ for 10 minutes.

2. Using the bath B, reverse electrolytic processing was carried out at a current density of 100 A/$m^2$ for 17.5 seconds.

3. Using the bath C, second plating was carried out at a constant electric potential of −550 mV (vs. mercury sulfate electrode) for one hour (Example 1) or two hours (Example 2).

Figure 5A:
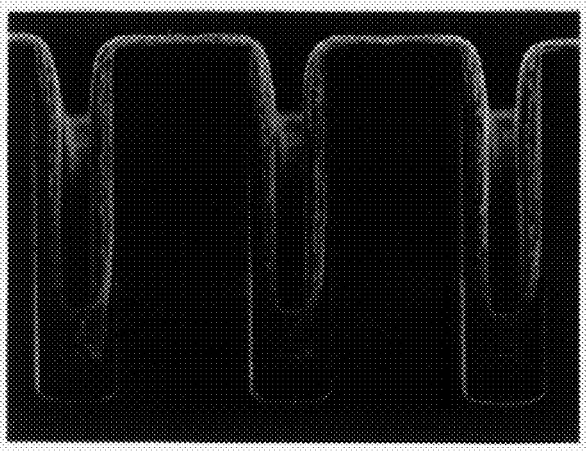
FIG. 5A is a photomicrograph of a substrate surface after plating in Example 1, showing the state of filling of a copper plated film into interconnect trenches.
Figure 5B:
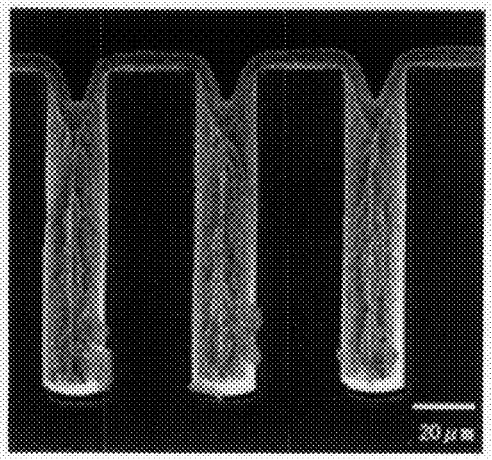
FIG. 5B is a photomicrograph of a substrate surface after plating in Example 2, showing the state of filling of a copper plated film into interconnect trenches.

After the series of processings, the surface of the substrate was observed microscopically. FIG. 5A is a photomicrograph showing the state of filling of a copper plated film into the interconnect trenches of the substrate after carrying out the constant-potential plating (second plating) for one hour (Example 1). FIG. 5B is a photomicrograph showing the state of filling of a copper plated film into the trenches of the substrate after carrying out the constant-potential plating for two hours (Example 2). It can be seen from FIGS. 5A and 5B that the processes of Examples 1 and 2 can achieve ideal filling of copper plated film into the interconnect trenches without the formation of voids in the trenches. Good filling of copper is possible also for different interconnect patterns by adjusting the plating current, the reverse electrolytic current, the $Cl^-$ concentration, etc.

COMPARATIVE EXAMPLE 1

Filling of a copper plated film into interconnect trenches was carried out on the same substrate as used in Examples 1 and 2, but only by the first plating using the plating solution that utilizes the action of the plating accelerator (Comparative Example 1). Thus, only the following bath A was used.

Bath A: Acidic copper sulfate solution ($CuSO_4$, 0.9 M; $H_2SO_4$, 0.56 M)

PEG 0.1 mM

SPS 5.6 μM

Chloride ion ($Cl^-$) 1 mM

Using the bath A, first plating was carried out at a current density of 100 A/$m^2$ for one hour.

Figure 6:
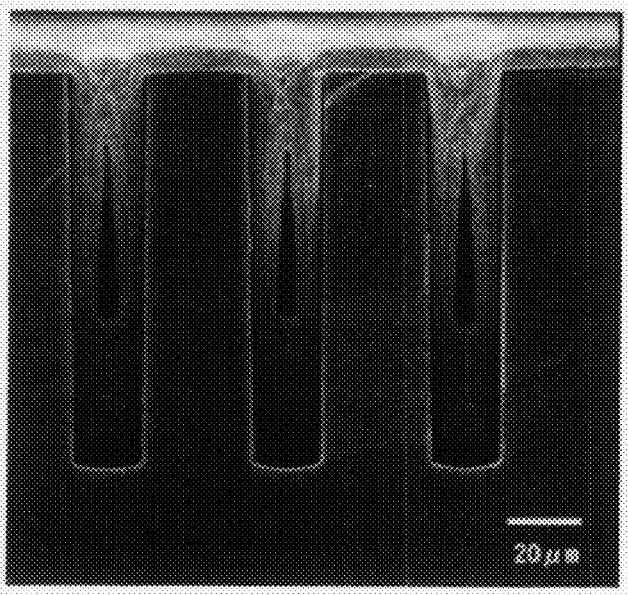
FIG. 6 is a photomicrograph of a substrate surface after plating in Comp. Example 1, showing the state of filling of a copper plated film into interconnect trenches.

After the plating, the surface of the substrate was observed microscopically. FIG. 6 is a photomicrograph showing the state of filling of copper plated film into the interconnect trenches of the substrate. As shown in FIG. 6, the bottom-up effect of the plating accelerator can be seen in the bottom portions of the trenches. On the other hand, the openings of the trenches are closed up due to preferential deposition of copper in the upper portions of the trenches. A leveler must be used to overcome this drawback.

As described hereinabove, according to the present invention, a metal, such as copper or a copper alloy, can be plated into fine recesses in a substrate, such as fine interconnect trenches (including trenches for forming interconnects in a substrate and trenches for three-dimensional packaging), without the formation of voids in the metal-filled recesses.

What is claimed is:

1. A substrate plating method comprising:

preparing a substrate having trenches or holes for use in three-dimensional packaging, the trenches or holes being formed in a surface of the substrate to be plated;

performing a first electroplating process on the surface of the substrate by immersing the substrate and a first anode in a first electrolytic solution containing a plating accelerator as an additive such that the substrate and the first anode face each other, and applying a voltage between the substrate serving as a cathode and the first anode, so that a plated metal film is formed on the surface to be plated of the substrate while allowing the plating accelerator to be adsorbed onto a plating surface of the plated metal film;

performing a plating accelerator removal process by immersing a cathode and the substrate with the plating surface into a second electrolytic solution containing a remover and without the plating accelerator such that the substrate and the cathode face each other, and applying a voltage between the substrate serving as an anode and the cathode, thereby removing the plating accelerator from an outer portion of the plating surface and areas of openings of the trenches or holes while leaving the plating accelerator in the deep portions of the trenches or holes; and then performing a second electroplating process on the plating surface of the plated metal film at a constant electric potential by immersing the substrate and a second anode into a third electrolytic solution without the plating accelerator such that the substrate and the second anode face each other, and applying a voltage between the substrate serving as a cathode and the second anode.

2. The substrate plating method according to claim 1, wherein the plating accelerator comprises a sulfur compound.

3. The substrate plating method according to claim 1, wherein the remover removes the plating accelerator by competitive adsorption.

4. The substrate plating method according to claim 3, wherein the remover comprises chloride ions.

5. The substrate plating method according to claim 1, wherein said performing of the second electroplating process includes detecting a change in electric current during the second electroplating process;

said substrate plating method further comprising, when the detected current value has decreased to a predetermined value or lower with respect to the initial current value, performing the first electroplating process, the plating accelerator removal process, and then the constant-electric-potential second electroplating process again.

6. The substrate plating method according to claim 1, wherein the first electroplating process is performed at a constant current with a current density in a range of 10 A/$m^2$ to 100 A/$m^2$.

7. The substrate plating method according to claim 1, wherein the plating accelerator removal process is performed while stirring the second electrolytic solution.

8. The substrate plating method according to claim 1, wherein the first electroplating process, the plating accelerator removal process, and the second electroplating process are repeated.

9. The substrate plating method according to claim 1, further comprising cleaning of the substrate between the first electroplating process, the plating accelerator removal process, and the second electroplating process.

10. The substrate plating method according to claim 1, wherein the second electrolytic solution has a chloride ion concentration higher than a chloride ion concentration of the first electrolytic solution.

11. The substrate plating method according to claim 10, wherein the second electrolytic solution has a chloride ion concentration in a range of 1 mg/L to 100 mg/L.

* * * * *